United States Patent [19]

Morris, Jr. et al.

[11] 4,084,919

[45] Apr. 18, 1978

[54] MEANS OF ATTACHING A SEAL TO A DISK

[75] Inventors: Edwin Morris, Jr., Lake Park; David F. Toler, Riviera Beach, both of Fla.

[73] Assignee: United Technologies Corporation, Hartford, Conn.

[21] Appl. No.: 701,004

[22] Filed: Jun. 29, 1976

[51] Int. Cl.[2] ..... F01D 5/20

[52] U.S. Cl. ..... 415/136; 415/172 A; 277/56

[58] Field of Search ..... 415/172 A, 172 R, 170 R, 415/137, 136, 134, 173 R, 173 A; 277/53, 54, 55, 56; 60/39.75

[56] References Cited

U.S. PATENT DOCUMENTS

| | | | |
|---|---|---|---|
| 3,023,998 | 3/1962 | Sanderson | 415/170 R |
| 3,514,112 | 5/1970 | Pettengill | 277/53 X |
| 3,727,660 | 4/1973 | Burge | 415/172 A X |
| 3,807,891 | 4/1974 | McDow et al. | 415/134 X |

*Primary Examiner*—Carlton R. Croyle
*Assistant Examiner*—Donald S. Holland
*Attorney, Agent, or Firm*—Jack N. McCarthy

[57] ABSTRACT

An arrangement is set forth for mounting knife edge seals on a rotating bladed disk for sealing cooperation with sealing lands on a ring, fixed against rotation, connected to the inner ends of adjacent vanes. The knife edge seals are fixed to a sealing member which is removably positioned on a cylindrical-like flange on the disk. Radially mounted headed pins, held in position by centrifugal force during engine operation, fix the sealing member to the disk flange, while a pin retaining ring holds the pins in place when the disk is at rest.

2 Claims, 3 Drawing Figures

MEANS OF ATTACHING A SEAL TO A DISK

BACKGROUND OF THE INVENTION

This invention relates to the attachment of a thermally responsive device for minimizing leakage between the rotor disk and inner ring of adjacent stationary vanes during engine operation, while being easily removable. In this art many devices have been used for sealing. A sample of these are shown by U.S. Pat. Nos. 3,023,998; 3,455,537 and 3,841,792.

SUMMARY OF THE INVENTION

A primary object of this invention is to provide a removable interstage sealing device to a disk which will maintain a positive seal between a rotating seal member and a stationary seal member.

Another object of this invention is to provide a means of attaching an interstage sealing device, which also holds the blades on the disk, and which can be easily detached in the field for blade removal.

Another object of this invention is to provide a plurality of pins axially and circumferentially fixing an annular member of U-shaped cross-section to an axially extending annular disk flange with a double snap fit such that the annular U-shaped member can respond radially to transients while maintaining a positive seal with the disk flange.

A further objective of this invention is to provide a plurality of headed pins held in radial position by centrifugal force and prevented from becoming dislocated when at rest by a retaining ring.

DESCRIPTION OF THE PREFERRED EMBODIMENT

Figure 1:
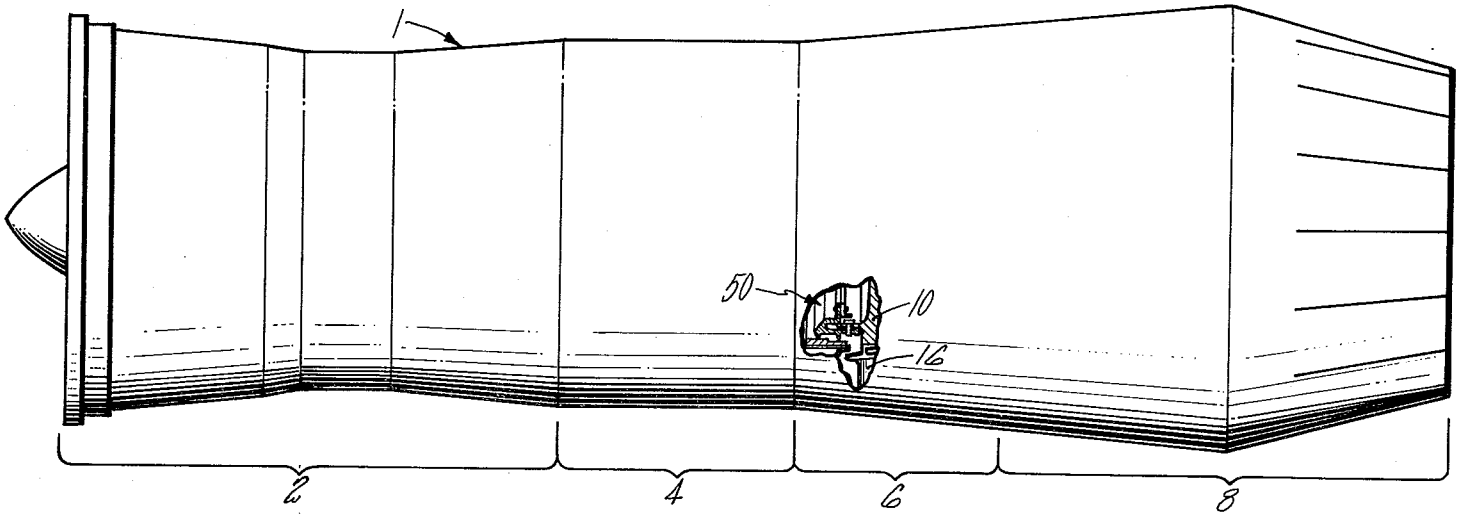
FIG. 1 is a representative showing of an aircraft gas turbine fan engine with a section broken away showing the location of the invention.
Figure 2:
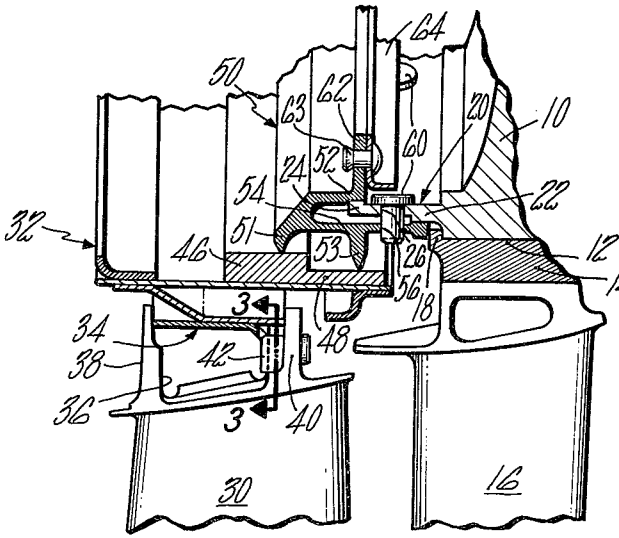
FIG. 2 is an enlarged view of the area shown by the broken away section in FIG. 1.
Figure 3:
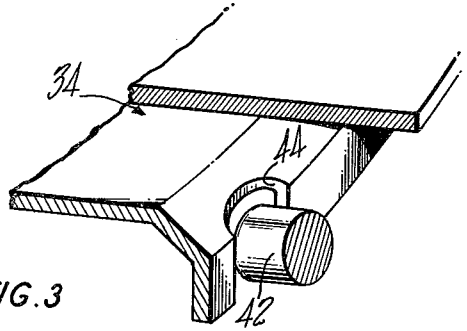
FIG. 3 is a view taken generally along the line 3—3 of FIG. 2 showing the associated parts in perspective.

Referring to FIG. 1 a gas turbine power plant 1 is shown of the fan type. The power plant has a fan and compressor section 2, a combustion section 4, a turbine section 6 and an exhaust section 8. The turbine section 6 is shown broken away to locate the invention. An enlarged view of this is shown in FIG. 2.

The turbine rotor is of conventional design including a rotor disk 10. A part of one of these is shown in FIG. 1 and FIG. 2. The rotor disk 10 has a plurality of contoured slots 12 around the outer edge thereof for receiving the roots 14 of blades 16. A tab 18 extends inwardly from the forward side of each blade to contact the disk 10 to position the blade axially in its cooperating slot 12.

An axially extending annular flange 20 extends forwardly of the disk 10 at a point adjacent the inside of the inner faces of the tabs 18. The annular flange 20 is constructed with a raised annular portion 22 on its outer side adjacent to the disk 10 and a raised annular portion 24 on its inner side at the free end thereof. A plurality of openings 26 are located around the flange 20 for a purpose to be hereinafter disclosed.

A plurality of vanes 30 are positioned in the turbine section 6, fixed to the outer casing thereof, with their inner ends connected to an inner sealing ring 32. The inner sealing ring 32 is provided with an outer annular projection means 34 which extends into the annular groove 36 formed between adjacent flanges 38 and 40 of adjacent vanes 30. The annular member 34 is positioned therein for relative movement, while maintaining it centered, by having pins 42 fixed to flanges 40 positioned in radial grooves 44 in the projection means 34.

Annular stepped seal lands 46 and 48 are positioned on the inside of the inner sealing ring 32. The lands 46 and 48 can be made of any one of many conventional seal materials and constructions. One of these could be a metallic honeycomb.

An annular rotating sealing member 50 having two annular outwardly extending knife edge seals 51 and 53 is fixedly mounted on flange 20 of disk 10 for sealing engagement with seal lands 46 and 48, respectively. The sealing member 50 is of a U-shaped cross-section having different arm lengths. The inner annular arm 52 is short and has the outside surface of its end engaging the raised annular portion 24 of the flange 20, and the outer annular arm 54 is long and has the inside surface of its end engaging the raised annular portion 22 of the flange 20. The arms 52 and 54 are spaced apart a distance less than the distance between the inner surface on raised annular portion 24 and the outer surface on raised annular portion 22. This provides a snap engagement at both locations of contact between the sealing member 50 and flange 20. The axial end face of the outer annular arm 54 contacts the forward faces of the tabs 18 to hold the blades in place. A plurality of openings 56 are located around the outer annular arm 54 which are the same in number and aligned with the openings 26 around the flange 20. A pin 60 having a head is placed through each set of aligned openings 26 and 56 with the head being located radially inwardly and adjacent the flange 20. It can be seen that since flange 20 rotates with disk 10 during engine operation, that pins 60 are held in position by centrifugal force with the heads of the pins 60 forced against the flange 20. An annular flange 62 extends inwardly from the end of arm 52. A pin retaining ring 64 for preventing the loss of a pin 60 when the flange 20 is not rotating is shown riveted to the flange 62 by rivets 63 and has an axially extending annular flange adjacent the heads of the pins 60. It can be seen that the pins 60 can be easily removed by removing the rivets 63 and moving the pin retaining ring 64 rearwardly until the heads of the pins 60 are uncovered. It is to be understood that the sealing area between the rotor disk 10 and the inner ends of vanes 30 reaches elevated temperatures, well known in the engine art, and the attaching means must allow for any material growth changes due to temperature changes. The attaching means is constructed to respond radially to changing radial positions encountered when the engine is in operation.

We claim:

1. In combination, a sealing device for use between a rotating disk having blades and the inner ends of vanes, comprising a disk mounted for rotation, said disk having blades mounted thereon, vanes mounted adjacent to said blades, a ring connected to the inner ends of said vanes, a first annular seal means fixed to the interior of said ring, an annular flange extending axially from said disk having a free end and an inner surface and outer surface, a second annular sealing member fixed to said flange, said second annular sealing member being U-shaped in cross-section with an inner and outer arm, said inner arm having an end, said outer arm having an end, the end of said inner arm contacts the inner surface of the flange and the end of the said outer arm contacts the outer surface of the flange, said flange and U-shaped sealing member having a plurality of aligned openings around the circumference thereof, a plurality of pins having enlarged heads, each pin having an enlarged head is located extending through each of the aligned openings with its head located inside of said flange for retaining said second annular sealing member to said flange, an inwardly radially extending flange fixed to the end of said inner arm, a pin retaining ring fixed to said inwardly radially extending flange for keeping said pins in place, said outer arm of said second annular sealing member having a knife edge seal for cooperating with said first annular seal means.

2. A combination as set forth in claim 1 wherein said annular flange has a first raised portion on its inner surface and a second raised portion on its outer surface which fit tightly between the inner and outer arms of said U-shaped sealing member with said pins having enlarged heads passing through said annular flange and at least one arm of said U-shaped sealing member, said sealing member responding freely radially during radial movement while maintaining at least one tight fit between the first raised portion and the inner arm or between the second raised portion and the outer arm.

* * * * *

UNITED STATES PATENT OFFICE

CERTIFICATE OF CORRECTION

PATENT NO. : 4,084,919

DATED : April 18, 1978

INVENTOR(S) : EDWIN MORRIS, JR. ET AL

It is certified that error appears in the above-identified patent and that said Letters Patent are hereby corrected as shown below:

After the "ABSTRACT OF THE DISCLOSURE" and before the "BACKGROUND OF THE INVENTION", insert the following paragraph:

-- The invention herein described was made in the course of or under a contract or subcontract with the Department of the Air Force --.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*